US007946587B1

(12) United States Patent
Renfro

(10) Patent No.: US 7,946,587 B1
(45) Date of Patent: May 24, 2011

(54) BALL STACKING GAME SYSTEM

(76) Inventor: Michael S. Renfro, Clearwater, FL (US)

( * ) Notice: Subject to any disclaimer, the term of this patent is extended or adjusted under 35 U.S.C. 154(b) by 0 days.

(21) Appl. No.: 12/462,006

(22) Filed: Jul. 28, 2009

(51) Int. Cl.
*A63F 3/00* (2006.01)

(52) U.S. Cl. ..... 273/241; 273/280; 273/287

(58) Field of Classification Search ..... 273/241, 273/280, 287
See application file for complete search history.

(56) References Cited

U.S. PATENT DOCUMENTS 2,485,143 A * 10/1949 Duncan ..... 273/290
3,556,526 A * 1/1971 Currie ..... 273/239
4,199,320 A * 4/1980 Balland ..... 8/139
5,116,061 A * 5/1992 Zentner, Jr. ..... 273/241
6,382,627 B1 * 5/2002 Lundberg ..... 273/285
2010/0148440 A1 * 6/2010 Hart ..... 273/241

* cited by examiner

*Primary Examiner* — Vishu K. Mendiratta

(57) ABSTRACT

A base has upper and lower surfaces. Cylindrical recesses are arranged in rows and columns. A plurality of rods is received by the cylindrical recesses and held in a vertical orientation. A plurality of balls is adapted to be stacked upon the rods. The balls have an exterior surface with various optical characteristics. The number of different optical characteristics of the balls corresponds to the number of players of the game. The optical characteristics are chosen from the class of optical characteristics including colors and designs. The game is won when a player aligns a predetermined number of balls of a common optical characteristic in a line in response to players alternately placing balls on the base.

1 Claim, 4 Drawing Sheets

FIG 1
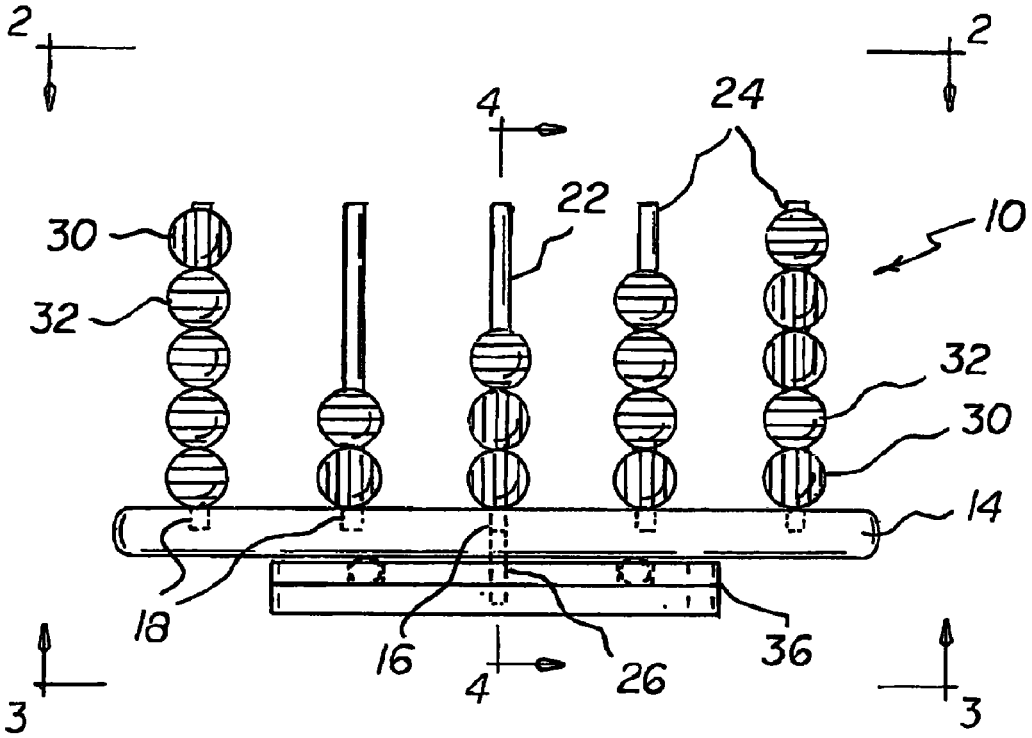
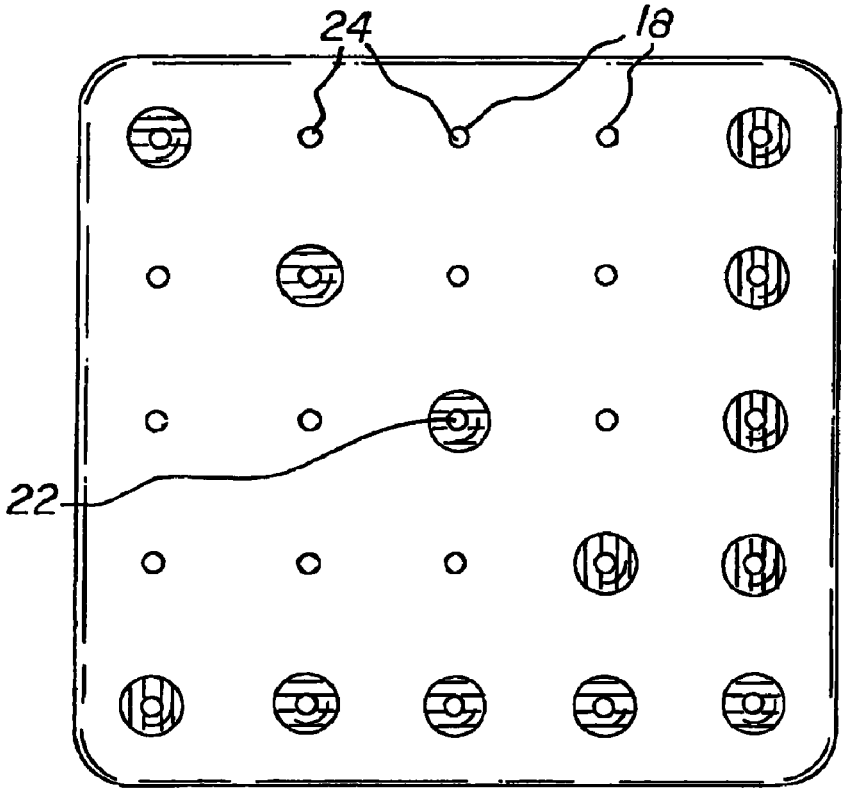
FIG 2

FIG 3
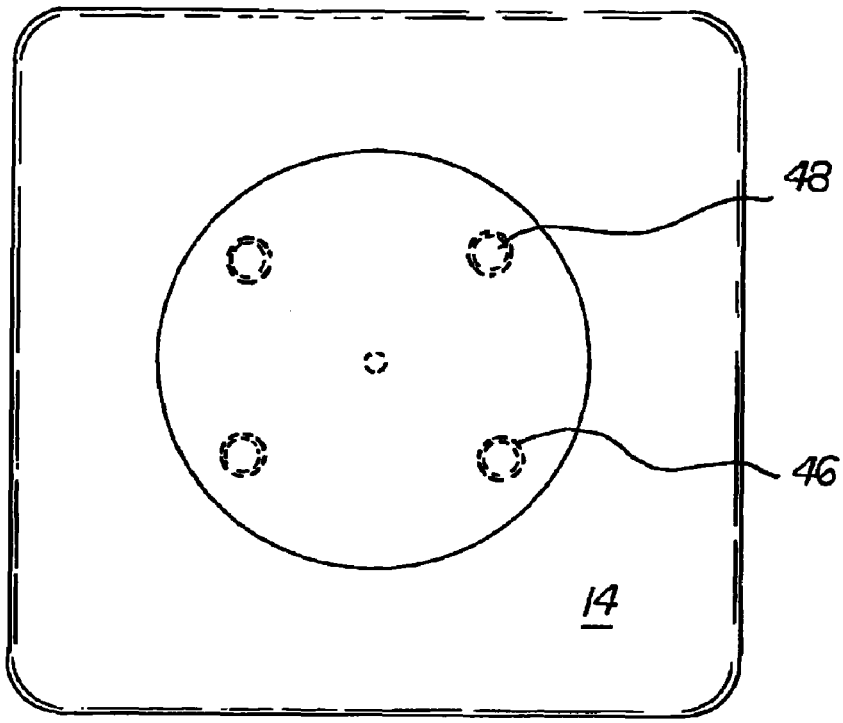
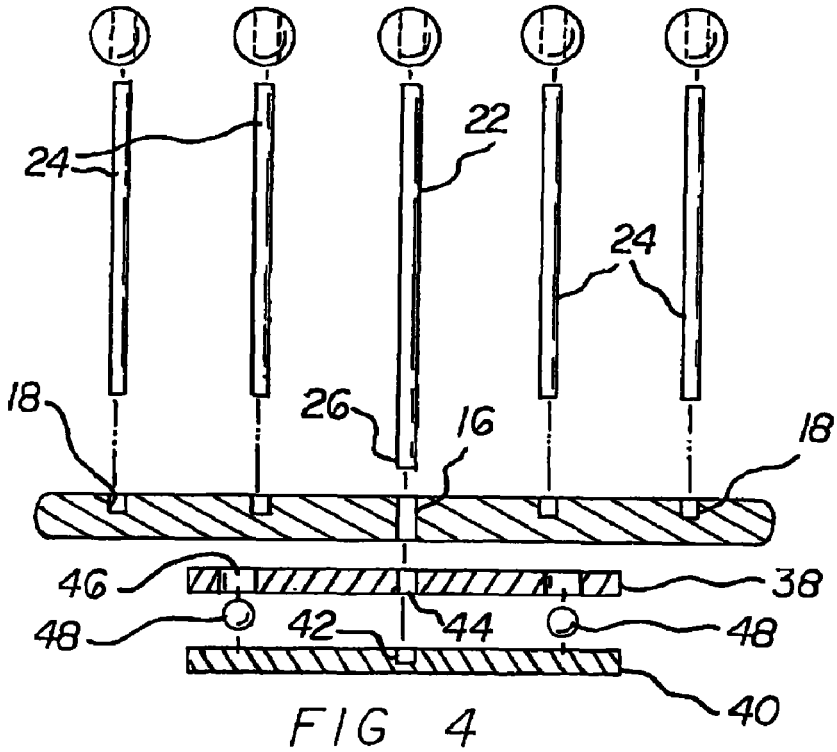
FIG 4

BALL STACKING GAME SYSTEM

BACKGROUND OF THE INVENTION

Field of the Invention

The present invention relates to a ball stacking game system and more particularly pertains to featuring competing players attempting to align balls of a common characteristic in a line vertically, horizontally or angularly, the competing requiring spatial comprehension and strategy.

SUMMARY OF THE INVENTION

In view of the disadvantages inherent in the known types of games of known designs and configurations now present in the prior art, the present invention provides an improved ball stacking game system. As such, the general purpose of the present invention, which will be described subsequently in greater detail, is to provide a new and improved ball stacking game system and method which has all the advantages of the prior art and none of the disadvantages.

To attain this, the present invention essentially comprises a ball stacking game system. First provided is a base. The base has a horizontal upper surface. The base has a horizontal lower surface. The base has a square periphery. The upper surface has 25 cylindrical recesses. The cylindrical recesses all have a common diameter. The cylindrical recesses are arranged in 5 rows and 5 columns. The cylindrical recesses include a central cylindrical recess and remaining cylindrical recesses. The central cylindrical recess extend through the base between the upper and lower surfaces. The remaining cylindrical recesses terminate between the upper and lower surfaces.

A plurality of cylindrical rods are provided. The cylindrical rods all have a common diameter. The cylindrical rods are adapted to be received by the cylindrical recesses of the base. In this manner the cylindrical rods are held in a vertical orientation. The rods include a central rod. The central rod is received by the central cylindrical recess. The rods include the remaining rods. The remaining rods are received by the remaining cylindrical recesses. The central rod has a length. The length of the central rod is greater than the remaining rods. The central rod has a lower extent. The lower extent of the central rod extends beneath the lower surface of the base. All of the rods have an upper end. The upper ends of the rods are provided at a common distance from the upper surface of the base.

Provided next is a plurality of balls. The balls all have a common exterior diameter. All of the balls have a cylindrical bore. The cylindrical bore has an axial length and a diameter. In this manner the ball may be slidably received by the rods. The axial length of each bore is essentially 20 percent of the length each rod extending above the base. In this manner a maximum of 5 balls are adapted to be received on any rod. The balls have an exterior surface. The exterior surface of the balls have various optical characteristics. The number of different various characteristics of the balls corresponds to the number of players of the game. The optical characteristics are chosen from the class of optical characteristics. The class of optical characteristics includes colors and designs. The game is won when a player aligns a predetermined numbers of balls of a common characteristics in a line in response to players alternately placing balls on the rods. The predetermined number is 5 when 2 players compete. The predetermined number is 4 when 3 or 4 players compete. The number is greater when a greater number of players compete and a larger grid of 7 by 7 rods or more is utilized.

Further provided is a rotatable assembly. The rotatable assembly is operatively coupled to and supported beneath the base. The rotatable assembly includes an upper plate. The rotatable assembly includes a lower plate. The lower plate has a central cylindrical recess. The recess fixedly receives the lower extent of the central rod. The upper plate has a central cylindrical recess. The recess rotatably receives the central rod between the base and the lower plate. The upper plate has 4 holes. The holes are equally spaced from the central rod. The rotatable assembly includes a sphere. The sphere is rotatably received within each hole. In this manner the balls will contact the base and the lower plate effecting rotation of the base with respect to the lower plate.

Provided last is a box for the base, rods, balls and rotatable assembly. The box is in a rectilinear configuration. The box has a square floor. The box has two upstanding opposed tall side walls. The box has two upstanding opposed short side walls. The box has inwardly facing side recesses. The side recesses are formed vertically in a central extent of each of the side walls. The box has inwardly facing end recesses. The end recesses are formed vertically at end extents of the tall side walls. The box has two similarly configured panels. Each panel is rectangular. Each panel has long upper and lower edges and short end edges. Each panel has a short slit. The slit extends from a long edge parallel with equally spaced from the end edges. The panels have a playing orientation. Note FIG. 6. The short end edges in the side recesses and the short slits intersect. In this manner the box is divided into four quadrants. The panels have a storage orientation. Note FIG. 5. In the storage orientation, the short end edges of the panels are in the end recesses and the panels are above the short side walls. The box also includes an associated lid.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ball stacking game system which has all of the advantages of the prior art games of known designs and configurations and none of the disadvantages.

It is another object of the present invention to provide a new and improved ball stacking game system which may be easily and efficiently manufactured and marketed.

It is further object of the present invention to provide a new and improved ball stacking game system which is of durable and reliable constructions.

An even further object of the present invention is to provide a new and improved ball stacking game system which is susceptible of a low cost of manufacture with regard to both materials and labor, and which accordingly is then susceptible of low prices of sale to the consuming public, thereby making such ball stacking game system economically available to the buying public.

Even still another object of the present invention is to provide a ball stacking game system for featuring competing players attempting to align balls of a common characteristic in a line vertically, horizontally or angularly, the competing requiring spatial comprehension and strategy.

Lastly, it is an object of the present invention to provide a new and improved ball stacking game system. A base has upper and lower surfaces. Cylindrical recesses are arranged in rows and columns. A plurality of rods is received by the cylindrical recesses and held in a vertical orientation. A plurality of balls is adapted to be stacked upon the rods. The balls have an exterior surface with various optical characteristics. The number of different optical characteristics of the balls corresponds to the number of players of the game. The optical characteristics are chosen from the class of optical characteristics including colors and designs. The game is won when a player aligns a predetermined number of balls of a common optical characteristic in a line in response to players alternately placing balls on the base.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a ball stacking game system constructed in accordance with the principles of the present invention.

FIG. 2 is a plan view of the ball stacking system taken along line 2-2 of FIG. 1.

FIG. 3 is a bottom of the system taken along line 3-3 of FIG. 1.

FIG. 4 is an exploded cross sectional view taken along line 3-3 of FIG. 1.

The same reference numerals refer to the same parts throughout the various Figures.

DESCRIPTION OF THE PREFERRED EMBODIMENT

Figure 5:
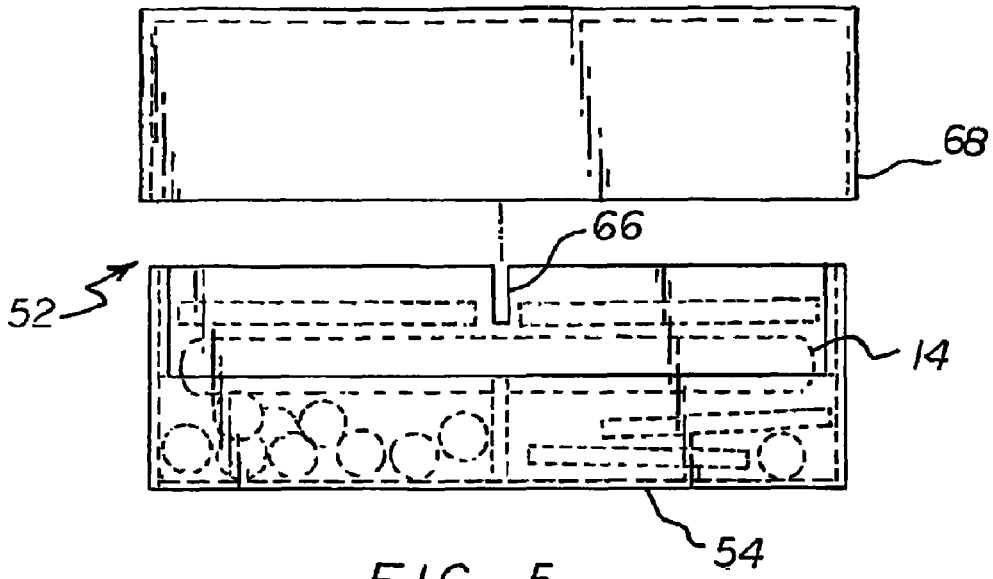
FIG. 5 is a side elevational view of a box for storing the components of the game system of the present invention.

With reference now to the drawings, and in particular to FIG. 1 thereof, the preferred embodiment of the new and improved ball stacking game system embodying the principles and concepts of the present invention and generally designated by the reference numeral 10 will be described.

The present invention, the ball stacking game system 10 is comprised of a plurality of components. Such components in their broadest context include a base, a plurality of rods and a plurality of balls. Such components are individually configured and correlated with respect to each other so as to attain the desired objective.

First provided is a base 14. The base has a horizontal upper surface. The base has a horizontal lower surface. The base has a square periphery. The upper surface has 25 cylindrical recesses 16, 18. The cylindrical recesses all have a common diameter. The cylindrical recesses are arranged in 5 rows and 5 columns. The cylindrical recesses include a central cylindrical recess 16 and remaining cylindrical recesses 18. The central cylindrical recess extends through the base between the upper and lower surfaces. The remaining cylindrical recesses terminate between the upper and lower surfaces.

A plurality of cylindrical rods 22, 24 are provided. The cylindrical rods all have a common diameter. The cylindrical rods are adapted to be received by the cylindrical recesses of the base. In this manner the cylindrical rods are held in a vertical orientation. The rods include a central rod 22. The central rod is received by the central cylindrical recess. The rods include the remaining rods 24. The remaining rods are received by the remaining cylindrical recesses. The central rod has a length. The length of the central rod is greater than the remaining rods. The central rod has a lower extent 26. The lower extent of the central rod extends beneath the lower surface of the base. All of the rods have an upper end. The upper ends of the rods are at a common distance from the upper surface of the base.

Provided next is a plurality of balls 30, 32. The balls all have a common exterior diameter. All of the balls have a cylindrical bore. The cylindrical bore has an axial length and a diameter. In this manner the ball may be slidably received by the rods. The axial length of each bore is essentially 20 percent of the length each rod extending above the base. In this manner a maximum of 5 balls are adapted to be received on any rod. The balls have an exterior surface. The exterior surface of the balls have various optical characteristics. The number of different various characteristics of the balls corresponds to the number of players of the game. The optical characteristics are chosen from the class of optical characteristics. The class of optical characteristics includes colors and designs. The game is won when a player aligns a predetermined numbers of balls of a common characteristics in a line in response to players alternately placing balls on the rods. The predetermined number is 5 when 2 players compete. The predetermined number is 4 when 3 or 4 players compete. The number is greater when a greater number of players compete and a larger grid of 7 by 7 rods or more is utilized.

Further provided is a rotatable assembly 36. The rotatable assembly is operatively coupled to and supported beneath the base. The rotatable assembly includes an upper plate 38. The rotatable assembly includes a lower plate 40. The lower plate has a central cylindrical recess 42. The recess fixedly receives the lower extent of the central rod. The upper plate has a central cylindrical recess 44. The recess rotatably receives the central rod between the base and the lower plate. The upper plate has 4 holes 46. The holes are equally spaced from the central rod. The rotatable assembly includes a sphere 48. The sphere is rotatably received within each hole. In this manner the balls will contact the base and the lower plate effecting rotation of the base with respect to the lower plate.

Figure 6:
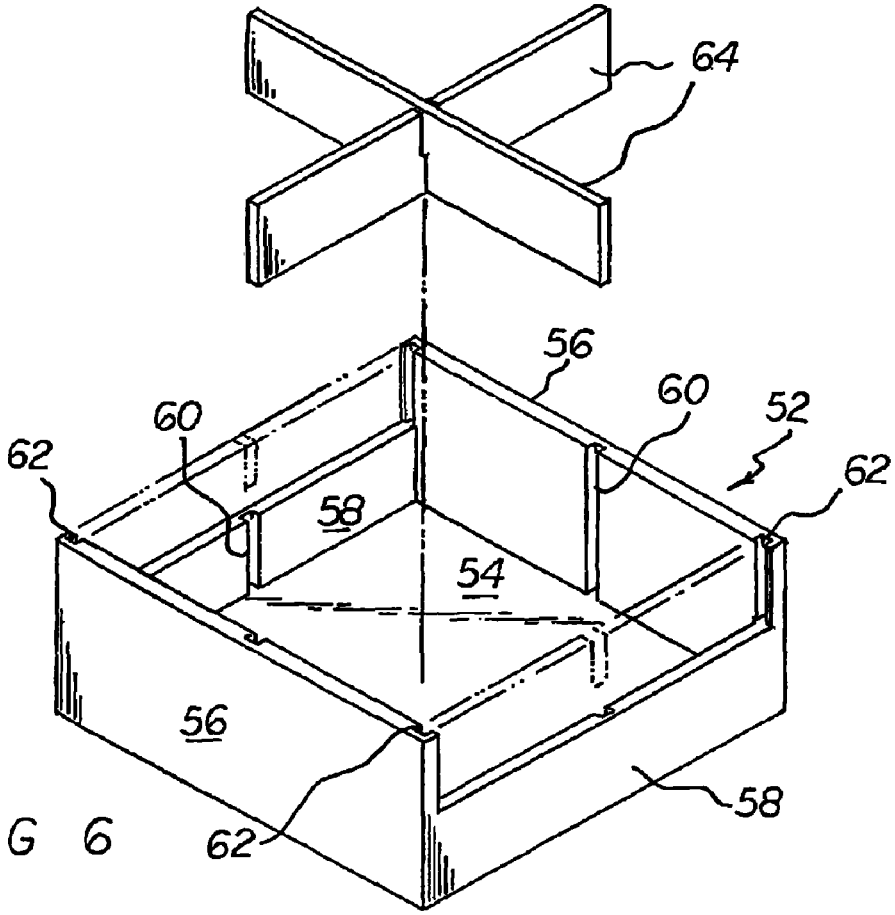
FIG. 6 is an exploded perspective illustration of the box shown in FIG. 5.

Provided last is a box 52 for the base, rods, balls and rotatable assembly. The box is in a rectilinear configuration. The box has a square floor 54. The box has two upstanding opposed tall side walls 56. The box has two upstanding opposed short side walls 58. The box has inwardly facing side recesses 60. The side recesses are formed vertically in a central extent of each of the side walls. The box has inwardly facing end recesses 62. The end recesses are formed vertically at end extents of the tall side walls. The box has two similarly configured panels 64. Each panel is rectangular. Each panel has long upper and lower edges and short end edges. Each panel has a short slit 66. The slit extends from a long edge parallel with equally spaced from the end edges. The panels have a playing orientation. Note FIG. 6. The short end edges in the side recesses and the short slits intersect. In this manner the box is divided into four quadrants. The panels have a storage orientation. Note FIG. 5. In the storage orientation, the short end edges of the panels are in the end recesses and the panels are above the side walls. The box also includes an associated lid 68.

Figure 7:
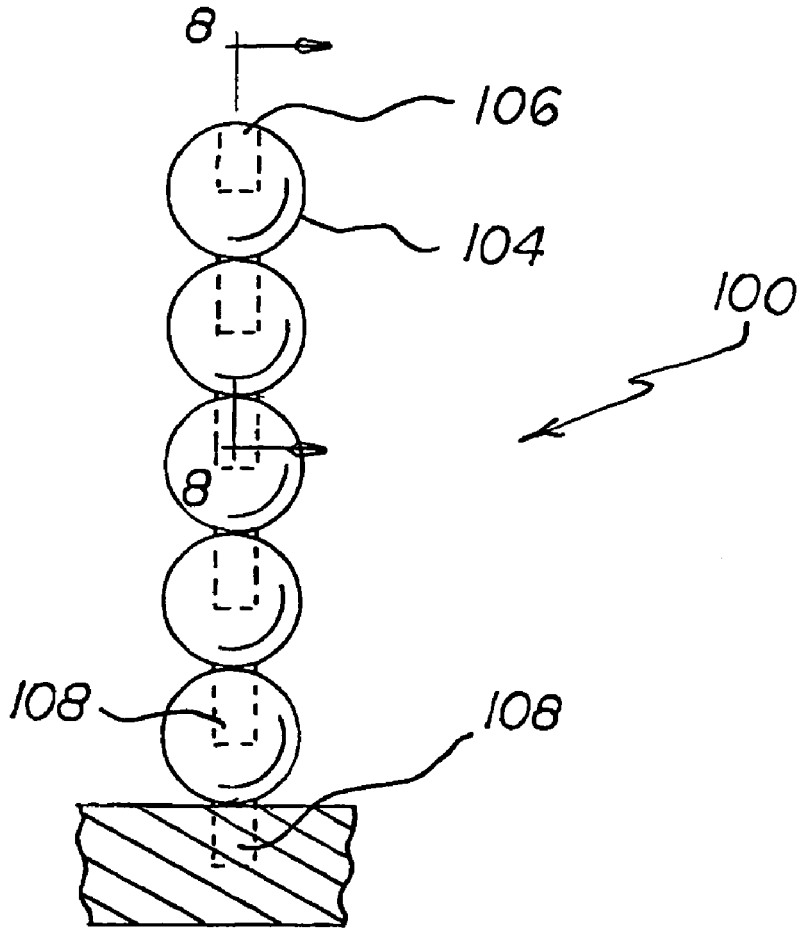
FIG. 7 is a side elevational view illustrating stacked balls but illustrating an alternate embodiment of the invention.
Figure 8:
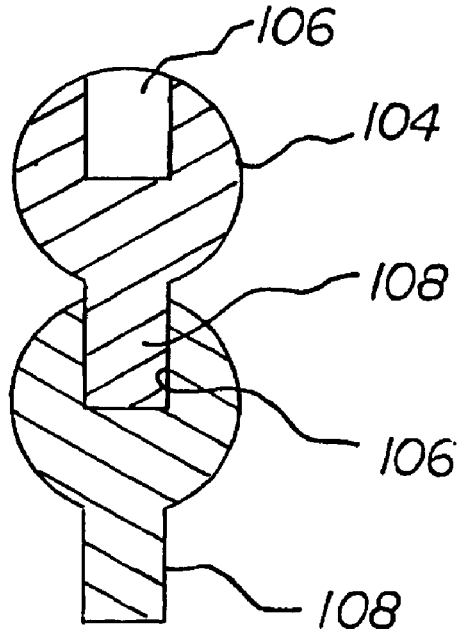
FIG. 8 is a cross sectional view taken along line 8-8 of FIG. 7.

Note the alternate embodiment 100 of FIGS. 7 and 8. A plurality of the balls 104 is provided. Each of the balls has a central axial depression 106. A plurality of rods 108 is provided. Each of the rods is coaxial with the depression. Each of the rods has a size essentially equal to the depression for stacking above the cylindrical recesses of the plate. As such, each ball has a depression and an associated rod receivable in an associated recess.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ball stacking game system featuring competing players attempting to align balls of a common characteristic in a line vertically, horizontally or angularly, the system comprising, in combination:

a base having a horizontal upper surface and a horizontal lower surface and a square periphery, the upper surface being formed with 25 cylindrical recesses all of a common diameter, the cylindrical recesses being a central cylindrical recess and remaining cylindrical recesses arranged in five rows and five columns, the central cylindrical recess extending through the base between the upper and lower surfaces, the remaining cylindrical recesses terminating between the upper and lower surfaces;

a plurality of cylindrical rods all of a common diameter adapted to be received by the cylindrical recesses of the base and held in a vertical orientation, the rods including a central rod in the central cylindrical recess and remaining rods in the remaining cylindrical recesses, the central rod being of a length greater than the remaining rods, the central rod having a lower extent extending beneath the lower surface of the base, all of the rods having an upper end at a common distance from the upper surface of the base;

a plurality of balls, all of the balls being of a common exterior diameter, all of the balls having a cylindrical bore with an axial length and a diameter to be slidably received by the rods, the axial length of each bore being essentially 20 percent of the length of each rod extending above the base whereby a maximum of five balls are adapted to be received on any of the rods, the balls having an exterior surface with various optical characteristics, the number of various optical characteristics of the balls corresponding to the number of players of the game, the optical characteristics being chosen from the class of optical characteristics including colors and designs, the game being won when a player aligns a predetermined numbers of the balls of a common one of the optical characteristics in a line in response to players alternately placing the balls on the rods, the predetermined number being five when two players compete, the number being four when three or four players compete;

a rotatable assembly operatively coupled to and supported beneath the base, the rotatable assembly including an upper plate and a lower plate, the lower plate having a central cylindrical recess fixedly receiving the lower extent of the central rod, the upper plate having a central cylindrical recess rotatably receiving the central rod between the base and the lower plate, the upper plate having four holes equally spaced from the central rod with a sphere rotatably received within each of the holes whereby the balls will contact the base and the lower plate for effecting rotation of the base with respect to the lower plate; and a box for the base, the rods, the balls and the rotatable assembly, the box being in a rectilinear configuration with a square floor and with two upstanding opposed tall side walls and with two upstanding opposed short side walls, inwardly facing side recesses formed vertically in a central extent of each of the side walls, inwardly facing end recesses formed vertically at end extents of the tall side walls, two similarly configured panels, each panel being rectangular with long upper and lower edges and with short end edges, each panel having a short slit extending from a long edge parallel with and equally spaced from the end edges, the panels having a playing orientation with the short end edges in the side recesses and the short slits intersecting to divide the box into a lower region with four quadrants and an enlarged upper region, the panels having a storage orientation with the short end edges of the panels in the end recesses and with the panels above the short side walls, the box also including an associated lid.

* * * * *